United States Patent [19]

Lin

[11] Patent Number: 5,052,253

[45] Date of Patent: Oct. 1, 1991

[54] SCREWDRIVER

[76] Inventor: Ching-Jou Lin, No. 148, Sec. 3, Chung-Shan Rd., Wu-Jih Hsiang, Taichung Hsien, Taiwan

[21] Appl. No.: 561,606

[22] Filed: Aug. 1, 1990

[51] Int. Cl.[5] ..... B25B 21/00

[52] U.S. Cl. ..... 81/457; 81/177.4; 81/489; 81/492

[58] Field of Search ..... 81/177.1, 177.4, 457, 81/489, 492

[56] References Cited

U.S. PATENT DOCUMENTS

| | | | |
|---|---|---|---|
| 774,112 | 11/1904 | Rundquist | 81/457 |
| 950,318 | 2/1910 | Dunning | 81/457 |
| 4,227,430 | 10/1980 | Jansson et al. | 81/177.4 |

*Primary Examiner*—James G. Smith

*Attorney, Agent, or Firm*—Bacon & Thomas

[57] ABSTRACT

A screwdriver comprising a handle having a sleeve mounted on the blade thereof for releasably fastening a screw head retainer socket to secure the device to a screw to be fastened or loosened. The handle is comprised of two sections which are permitted to rotate against each other.

3 Claims, 3 Drawing Sheets

SCREWDRIVER

BACKGROUND OF THE INVENTION

The present invention is related to screwdrivers, and more particularly to a screwdriver which is convenient in use for turning screws without stopping, and which can be firmly secured to a screw to be fastened or loosened during the screw turning operation.

A screwdriver is a hand tool for turning screws. During the screw turning operation through a single-piece type of hand-driven screwdriver, the hand-driven screwdriver must be frequently removed from a screw each time the user's wrist is turned to a certain angle. Therefore, a screw can not be continuously turned through a conventional single-piece type of hand-driven screwdriver without a temporary stop.

Further, before the tip of the blade of a hand-driven screwdriver fits into the slotted head of a screw, a screw must be held with the fingers or by an external tool to keep it in position. During driving, it is very difficult to hold a screw in position with the fingers or the external tool. This problem may be overcome by using a screwdriver which has a retainer socket for securing the blade of the screwdriver to a screw. A disadvantage of this type of screwdriver is that the retainer socket is fixedly latter secured to the blade thereof. For turning screws of different specifications, several screwdrivers with different specifications of retainer sockets may be required.

SUMMARY OF THE INVENTION

The present invention overcomes the aforementioned disadvantages. It is an object of the present invention to provide a screwdriver which has a changeable screw head retainer socket to accommodate the screwdriver to a screw to be fastened or loosened.

Another object of the present invention is to provide a screwdriver which is convenient in use for turning screws continuously.

According to the present invention, a screwdriver comprises a screw head retainer socket for securing the device to the head of a screw to be fastened or loosened, and a swivel member attached to the handle thereof permitting the handle to continuously drive the blade to turn a screw when the swivel member is firmly pressed down thereagainst.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
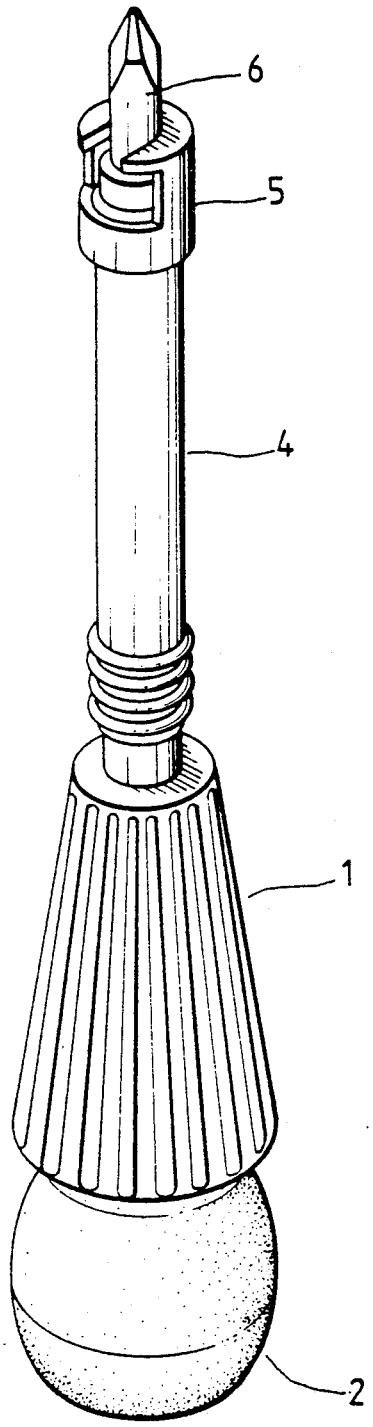
FIG. 1 illustrates the preferred embodiment of the present invention.
Figure 2:
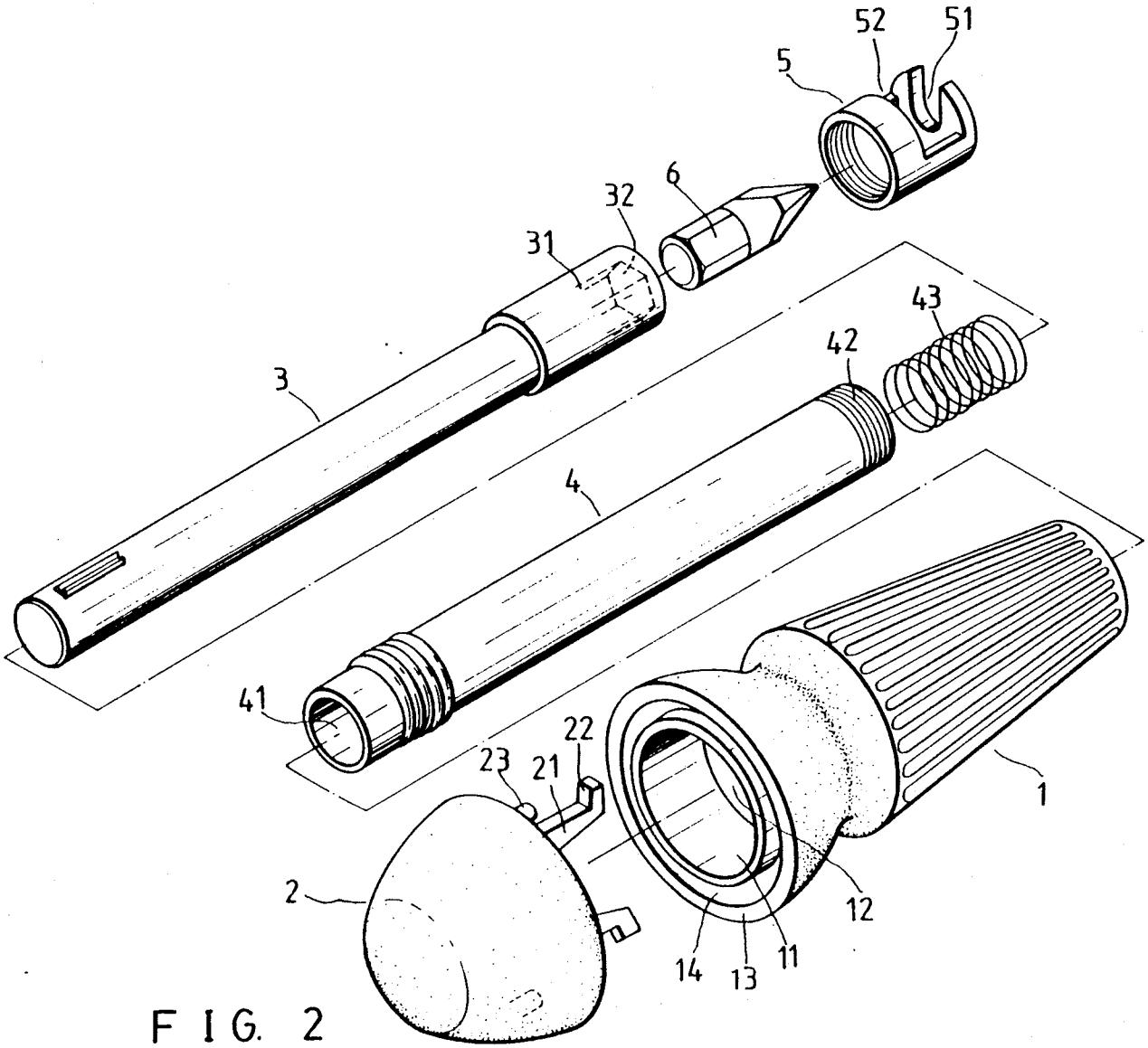
FIG. 2 is a perspective dismantled view of the preferred embodiment of the present invention.

Referring to FIG. 2, a screwdriver in accordance with the present invention comprises a handle 1, a swivel member 2, a link rod 3, a sleeve 4, and a screw head retainer socket 5. The handle 1 comprises a body shaped like a truncated cone and having a hollow, semi-spherical portion at one end for securing the swivel member 2. The link rod 3 is fastened in the handle 1 at an opposite end. The sleeve 4 is sleeved on the link rod 3 and secured to the handle 1 at one end, the opposite end of which is threadedly secured to the screw head retainer socket 5. A ring-shaped flange 11 is formed inside the hollow, semi-spherical portion of the handle 1 to define therein a round hole 12 and defining with the top edge 13 of the handle 1 a continuous circular channel 14.

Figure 3:
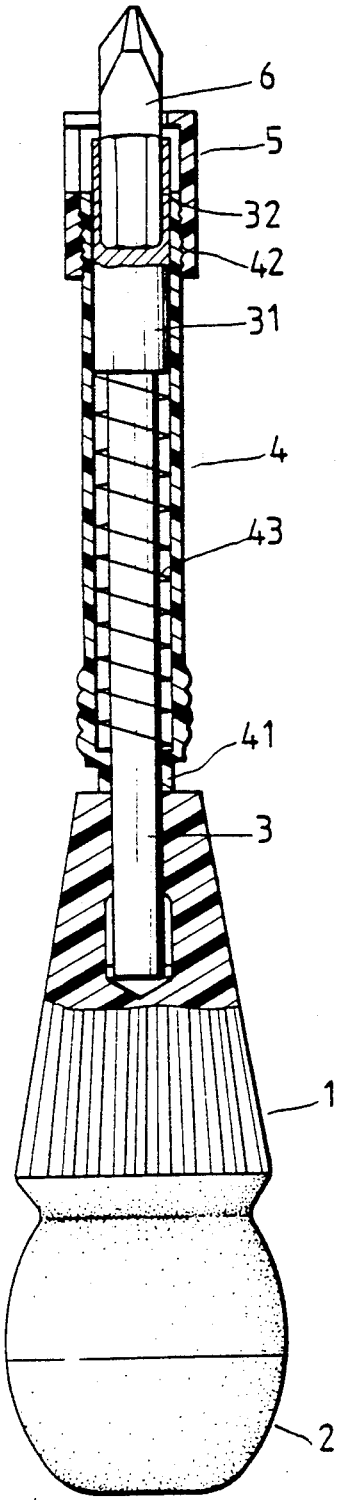
FIG. 3 is a partly longitudinal sectional view of the preferred embodiment of the present invention.

Referring to FIG. 3, the swivel member 2 is a semi-spherical shell provided internally with a plurality of projecting strips 21 respectively inserted in the round hole 12 on the top of the handle 1, permitting a hooked end 22 of each projecting strip 21 to lock up with the bottom edge of the flange 11. By means of the engagement of the projecting trips 21 with the flange 11, the swivel member 2 is firmly secured to the handle 1 at the top and permitted to rotate the handle 1 relative to through 360°.

Referring to FIGS. 2 and 3 again, the link rod 3 has one end fastened in the handle 1 and an opposite end attached with a tip driving socket 31 which is designed in diameter slightly larger than the link rod 3 and has internally a polygonal bore 32 for turning a tip 6 to drive a screw 7. The sleeve 4 has an inner diameter approximately equal to the outer diameter of the tip driving socket 31. However, the bore of the sleeve 4 at its top end 41 is relatively reduced. There is a compression spring 43 sleeved on the link rod 3 and set inside the sleeve 4 between the top end 41 and the tip driving socket 31.

Figure 4:
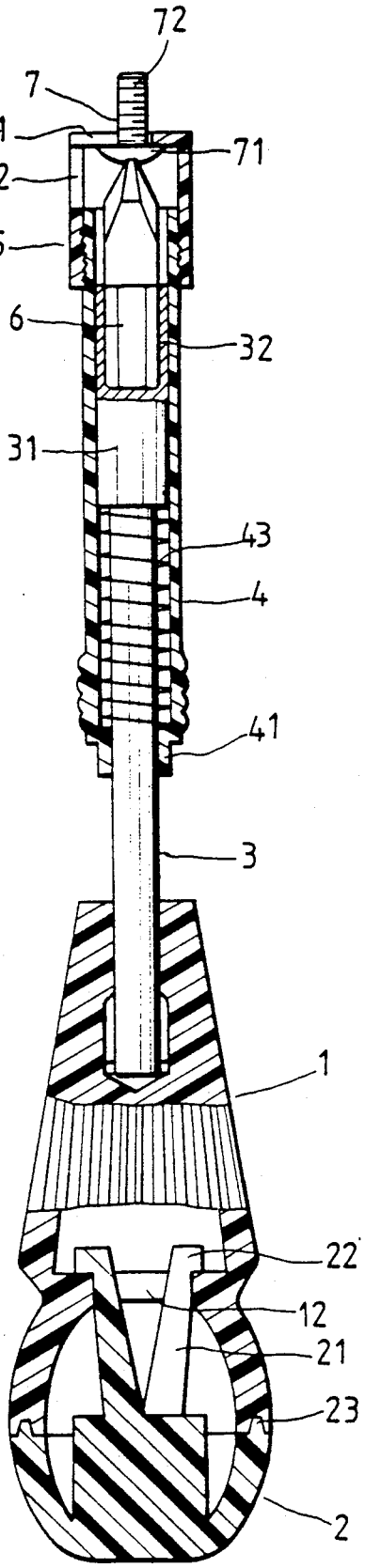
FIG. 4 is a longitudinal sectional view of the preferred embodiment of the present invention used in driving a screw.

The sleeve 4 comprises an outer thread 42 at the bottom end for fastening the screw head retainer socket 5 through a screw joint. The screw head retainer socket 5 comprises a bottom notch 51 and a side notch 52 respectively in communication with each other. During operation, the sleeve 4 is pushed forward from the handle 1 (see FIG. 4) permitting the head 71 of the screw 7 to be fastened or loosened to enter the screw head socket 5 through the side notch 52. Because the width of the bottom notch 51 is designed within a range between the outer diameter of the head 71 and the body 72 of the screw 7 to be fastened or loosened, the body 72 of the screw 7 is permitted to protrude beyond the bottom notch 51 and the head 71 of the screw 7 is retained against the bottom notch 51 inside the screw head retainer socket 5. Simultaneously, the compression spring 43 forces the link rod 3 to move forward, permitting the head 71 of the screw 7, while being fastened or loosened to be firmly retained between the tip 6 and the bottom notch 51 of the screw head retainer socket 5.

The swivel member 2 further comprises a plurality of unitary slide blocks 23 disposed in a circular array at the bottom for sliding engagement in the circular channel 14 of the handle 1 to stabilize the rotation of the handle 1 during the screw driving operation.

As described above, the screw head retainer socket 5 is connected to the sleeve 4 through a screw joint, therefore, screw head retainer sockets of same structure in different specifications can be alternatively used according to the specification of the tip 6 which is attached to the tip driving socket 31 for driving different types of screws 7.

A further advantage can also be achieved by the present invention. Because the swivel member 2 is rotatably attached to the top end of the handle 1, it can be firmly pressed down against the handle 1, thereby permitting the latter continuously rotated to turn the tip 6 to drive a screw 7 through the link rod 3 and the tip driving socket 31.

I claim:

1. A screwdriver comprising:

a) a handle including a main body portion having a substantially truncated cone configuration and a hollow end portion having an outer wall and a substantially semispherical configuration, the hollow end portion including an internal ring-shaped flange having a bottom edge, a round hole therein and defining a continuous circular channel with the outer wall;

b) a screw driving tool secured in an opposite end of the handle for driving screws; and c) a swivel member secured to the handle at the hollow end portion thereof, the swivel member including a plurality of retainer elements extending through the round hole of the ring-shaped flange and disposed in locking engagement with the bottom edge of the flange to permit the swivel member and the handle to rotate relative to each other through 360°, and a plurality of slide blocks disposed in sliding engagement within the circular channel for stabilizing the relative rotation of the swivel member and the handle.

2. The screwdriver of claim 1 further including:

a) a link rod fastened in the handle, the link rod including a tip driving socket for driving a screw turning tip;

b) a sleeve slidably received on the link rod, the sleeve including an outer thread formed on a bottom end and a reduced bore formed on a top end;

c) a compression spring received on the link rod within the sleeve, the spring being positioned between the reduced bore of the sleeve and the tip driving socket; and d) a screw head retainer socket including an inner thread at one end thereof for detachable connection with the outer thread at the bottom end of the sleeve to retain the head of a screw.

3. The screwdriver of claim 2 wherein the tip driving socket includes an internal bore of polygonal cross-section for engagement by the screw turning tip.

* * * * *